US006373443B1

(12) United States Patent
Tsai et al.

(10) Patent No.: US 6,373,443 B1
(45) Date of Patent: Apr. 16, 2002

(54) ARCUATE SLOT ANTENNA ASSEMBLY

(75) Inventors: Szu-Nan Tsai; Hsiang-Hui Shen; Hsin Kuo Dai; Kun Te Cheng, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,033

(22) Filed: Dec. 29, 2000

(30) Foreign Application Priority Data

Dec. 5, 2000 (TW) ..... 089221106

(51) Int. Cl.[7] ..... H01Q 13/10
(52) U.S. Cl. ..... 343/767; 343/702
(58) Field of Search ..... 343/700 MS, 702, 343/767, 769, 770

(56) References Cited

U.S. PATENT DOCUMENTS 5,600,337 A * 2/1997 Cassel ..... 343/770
5,729,237 A * 3/1998 Webb ..... 343/700 MS
5,917,454 A * 6/1999 Hill et al. ..... 343/769
5,945,954 A * 8/1999 Johnson ..... 343/702

* cited by examiner

*Primary Examiner*—Tan Ho
(74) *Attorney, Agent, or Firm*—Wei Te Chung

(57) ABSTRACT

A slot antenna assembly for an electronic device comprises an arcuate slot antenna (1) and a coaxial feeder cable (3). The slot antenna includes a metal foil (2) which is bent diagonally to form an arcuate surface (20). The slot antenna defines an elongated narrow slot (21) therein. The bent metal foil enlarges radiational scope, to achieve omni-directional radiation as well as increased radiation electric field intensity.

18 Claims, 12 Drawing Sheets

| 1:MKr (MHz) | 2: dB |
|---|---|
| 1: 2400.0000 | 1.789 |
| 2: 2450.0000 | 1.211 |
| 3: 2500.0000 | 2.096 |

| gain (dB) frequency / plane | 2400MHz | 2450MHz | 2500MHz |
|---|---|---|---|
| XY-OPEN-V | -14.82 | -13.99 | -14.52 |
| XY-OPEN-H | -3.49 | -3.19 | -4.65 |
| XY Avg. Gain | -3.18 | -2.84 | -4.22 |
| YZ-OPEN-V | -8.34 | -8.04 | -8.48 |
| YZ-OPEN-H | -13.61 | -13.31 | -14.46 |
| YZ Avg. Gain | -7.21 | -6.91 | -7.50 |
| XZ-OPEN-V | -10.46 | -9.30 | -10.91 |
| XZ-OPEN-H | -12.17 | -11.86 | -15.85 |
| XZ Avg. Gain | -8.22 | -7.38 | -9.70 |
| Total Average Gain | -5.63 | -5.20 | -6.56 |

FIG. 12

| gain (dB) frequency / plane | 2400MHz | 2450MHz | 2500MHz |
|---|---|---|---|
| XY-OPEN-V | -12.46 | -12.32 | -11.65 |
| XY-OPEN-H | -6.70 | -4.69 | -6.27 |
| XY Avg. Gain | -5.68 | -4.00 | -5.16 |
| YZ-OPEN-V | -7.98 | -7.86 | -8.91 |
| YZ-OPEN-H | -15.47 | -14.05 | -13.50 |
| YZ Avg. Gain | -7.27 | -6.92 | -7.61 |
| XZ-OPEN-V | -11.76 | -12.37 | -12.17 |
| XZ-OPEN-H | -13.45 | -13.71 | -13.27 |
| XZ Avg. Gain | -9.51 | -9.98 | -9.67 |
| Total Average Gain | -7.21 | -6.31 | -7.10 |

FIG. 15
(RELATED ART)

ARCUATE SLOT ANTENNA ASSEMBLY

FIELD OF THE INVENTION

The present invention relates to a slot antenna, and in particular to a slot antenna mounted in a portable electronic device and operating in the ISM (Industry, Science, Medicine) frequency band for communicating with various external electronic devices.

BACKGROUND OF THE INVENTION

There is a growing need for slot antennas for use in wireless communication devices such as notebook computers, Bluetooth apparatus, IEEE802.11 apparatus, wireless LANs, 2.4~2.5GHz apparatus, and in other applications. Commonly, a slot is formed in a conductive sheet, which is then used as a radiating or receiving element in an antenna. Slot antennas formed with flat metal foil are widely used.

FIG. 13 shows a conventional antenna assembly. A flat slot antenna 14 is made from a metal foil 10 having dimensions 68 mm ×11 mm, and has an elongated narrow slot 12 with dimensions 55 mm ×0.7 mm defined therein. A cable 13 has an inner core wire soldered to a flat surface 11 at a first feed-in point 132 near the slot 12, and an outer shield soldered to the flat surface 11 at a second feed-in point 131 near the slot 12 and opposite the first feed-in point 132. Each feed-in point 131, 132 is 4 mm away from an end of the slot 12.

FIG. 14 shows a measured radiation pattern of the flat slot antenna 14 of FIG. 13 in the X-Z plane. Radiation voids were present at angles 90° and 270° in the X-Z plane. In other words, the X-Z plane has low directivity. Furthermore, a resonant current of the slot in the X-Z plane is small. A measured electric field intensity of the X-Z plane is less than the electric field intensity of the X-Y plane and the Y-Z plane. Thus the radiation in the X-Z plane is weak. The flat slot antenna 14 does not achieve omni-directional radiation.

FIG. 15 shows a table of total average gains of the flat slot antenna 14 in the X-Y plane, the Y-Z plane and the X-Z plane at different frequencies when a conventional notebook computer is open.

As seen in FIG. 15, the average gain of the flat slot antenna 14 in the X-Z plane is 4~5 dB less than the average gain in the X-Y plane, and 2~3 dB less than in the Y-Z plane.

A notebook computer with an antenna mounted therein may be used in a variety of different locations. Each location has a different environment which can affect the proper functioning of the antenna. Thus the radiation electric field intensity of the antenna should be sufficiently large and omni-directional to allow the notebook to operate properly in various environments.

Hence, an improved antenna is desired to overcome the above-mentioned shortcomings of existing wireless network equipment.

BRIEF SUMMARY OF THE INVENTION

Therefore, a primary object of the present invention is to provide an antenna assembly having omni-directional radiation.

Another object of the present invention is to provide an antenna assembly having an arcuate shape for increasing effective radiation.

A further object of the present invention is to provide an antenna assembly occupying minimal space within an electronic device.

An antenna assembly in accordance with the present invention comprises an arcuate slot antenna and a coaxial feeder cable. The slot antenna comprises a metal foil which is bent diagonally to form an arcuate surface. The slot antenna defines an elongated narrow slot therein. An inner core of the cable is soldered to the arcuate surface at a first feed-in point near an end of the slot. An outer shield of the cable is soldered to the arcuate surface at a second feed-in point near the end of the slot and opposite the first feed-in point.

The slot antenna has a superior scope of maximum directive gain, and a superior total average gain in the X-Y plane, the Y-Z plane and the X-Z plane.

Other objects, advantages and novel features of the invention will become more apparent from the following detailed description of a preferred embodiment when taken in conjunction with the accompanying drawings.

BRIEF DESCRIPTION OF THE DRAWINGS

FIG. 12 shows a table of total average gains of the slot antenna assembly of FIG. 1 in the X-Y plane, the Y-Z plane and the X-Z plane at different frequencies when a lid of the notebook computer of FIG. 2 is open; frequencies when a lid of the notebook computer of FIG. 2 is open;

FIG. 15 shows a table of total average gains of the conventional flat slot antenna assembly of FIG. 13 in the X-Y plane, the Y-Z plane and the X-Z plane at different frequencies when a lid of a notebook computer is open.

DETAILED DESCRIPTION OF THE INVENTION

Reference will now be made in detail to a preferred embodiment of the present invention.

Figure 1:
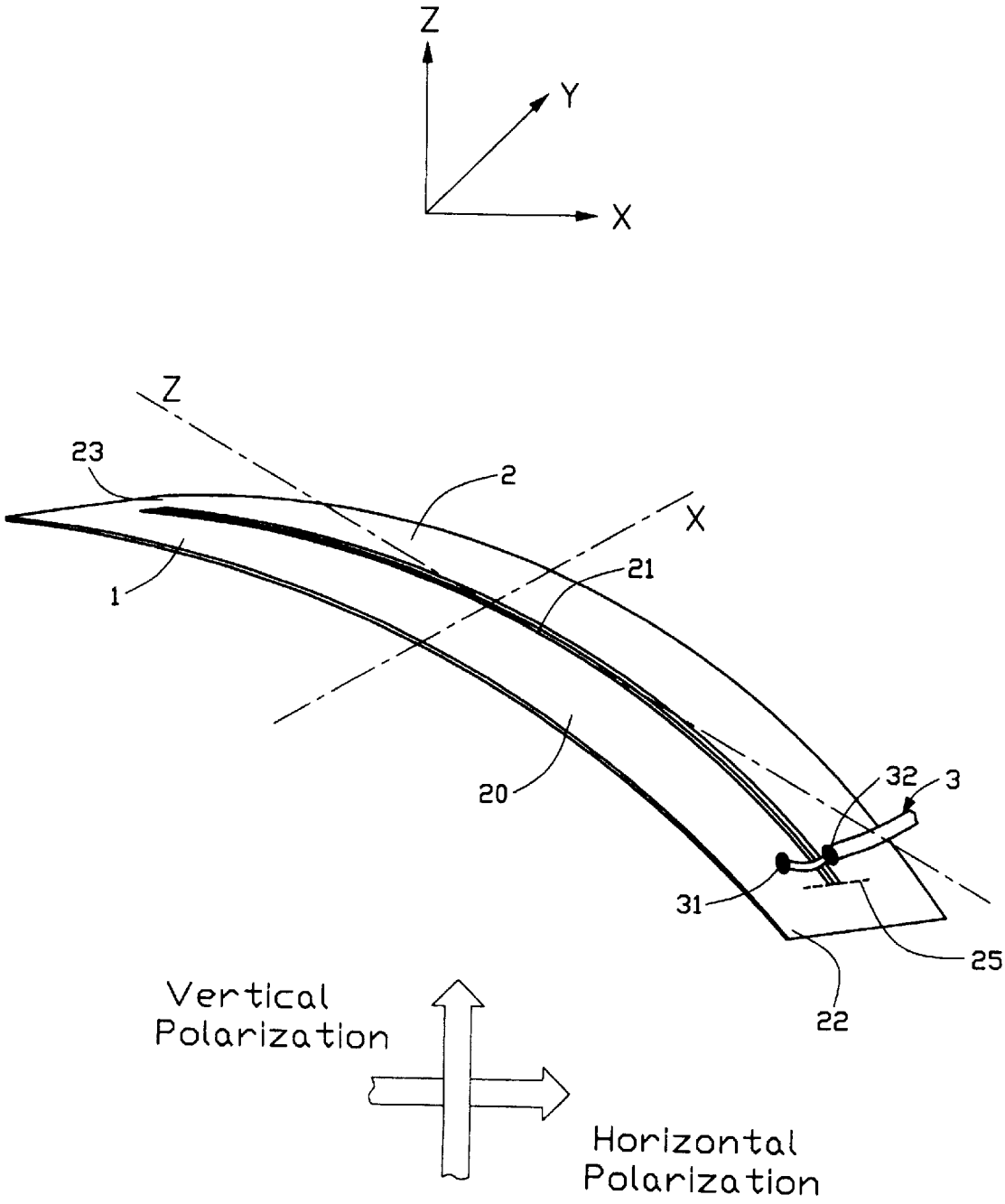
FIG. 1 is a perspective view of a slot antenna assembly in accordance with the present invention.

Referring to FIG. 1, a slot antenna assembly in accordance with the present invention comprises an arcuate slot antenna 1 and a coaxial feeder cable 3.

Figure 13:
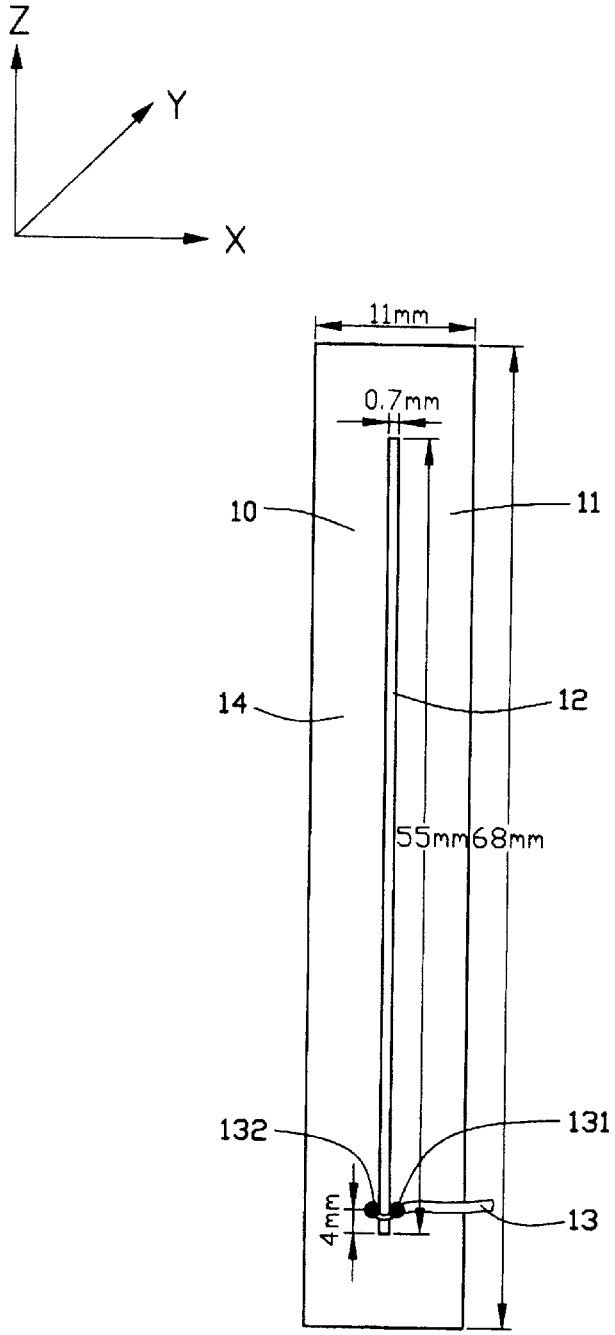
FIG. 13 (RELATED ART)
FIG. 13 is a top view of a conventional flat slot antenna assembly.
Figure 14:
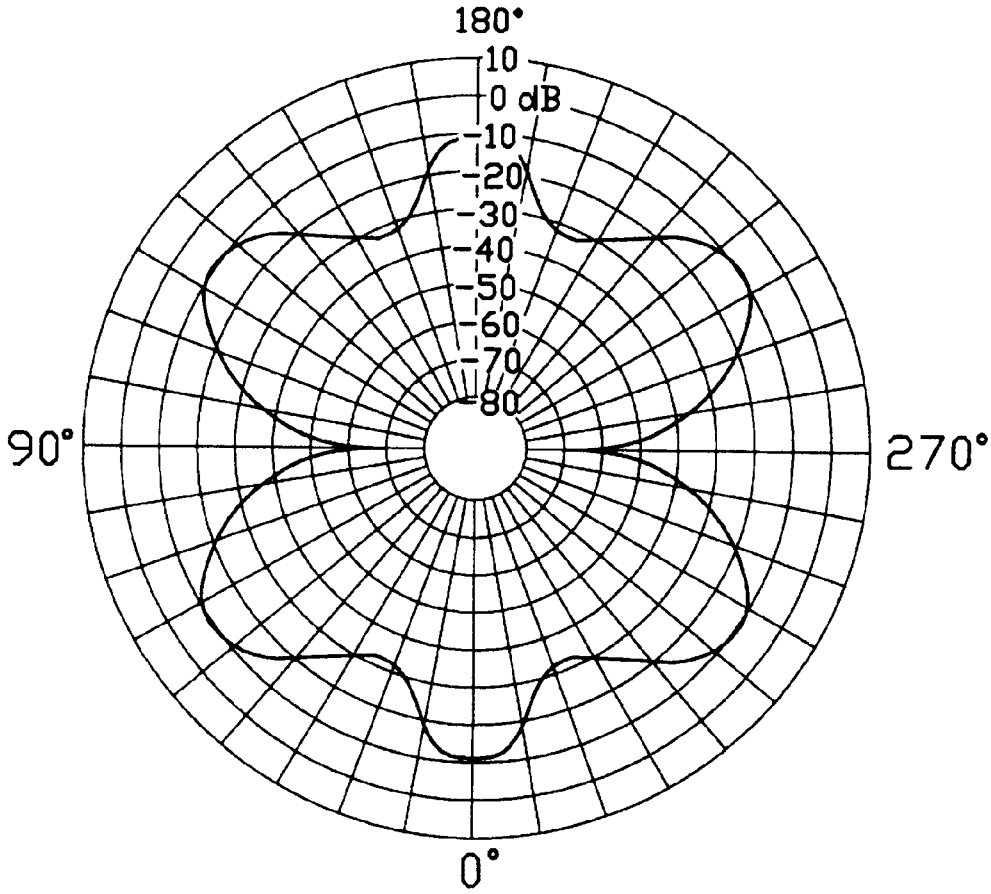
FIG. 14 (RELATED ART)
FIG. 14 shows a measured radiation pattern in an X-Z plane of the conventional flat slot antenna assembly of FIG. 13.

The slot antenna 1 comprises a metal foil 2. The metal foil 2 is diagonally bent between a first corner 22 and a second corner 23 thereof, and thereby forms an arcuate surface 20. The metal foil 2 can be bent according to a desired frequency band. In the preferred embodiment, the metal foil 2 has an arc length of 68 mm, and a width of 11 mm. These dimensions are equivalent to the dimensions of the conventional flat slot antenna 14 shown in FIG. 13. The metal foil 2 defines an elongated narrow slot 21 therein. The slot 21 can be dimensioned for operation at a predetermined frequency range. In the preferred embodiment, the slot 21 has dimensions 55 mm ×0.7 mm. The length of the slot 21 equals a half wavelength of the slot antenna 1, for operation in the frequency range from 2400 MHz to 2500 MHz. A reference line 25 is defined on the arcuate surface 20 at an end of the slot 21, and perpendicular to the slot 21. dimensions 55 mm ×0.7 mm. The length of the slot 21 equals a half wavelength of the slot antenna 1, for operation in the frequency range from 2400 MHz to 2500 MHz. A reference line 25 is defined on the arcuate surface 20 at an end of the slot 21, and perpendicular to the slot 21.

An inner core of the cable 3 is soldered to the arcuate surface 20 at a first feed-in point 31 near an end of the slot 21, and an outer shield of the cable 3 is soldered to the arcuate surface 20 at a second feed-in point 32 near the end of the slot 21 and opposite the first feed-in point 31.

The input impedance of a half-wavelength syntonical slot is 500 Ω, while the characteristic impedance of a coaxial cable is about 50 Ω according to the antenna theory. So feed-in points are generally positioned a distance away from a middle of a slot antenna in order to enable the characteristic impedance of a coaxial cable to match the input impedance of the slot and lower the Voltage Standing Wave Ratio (VSWR) of a slot antenna. In the preferred embodiment, each feed-in point 31, 32 is an arc distance of 4 mm away from the reference line 25. This distance is equivalent to the corresponding distance of the conventional flat slot antenna 14 shown in FIG. 13. The positions of the feed-in points 31, 32 may be modified according to degrees to which the slot antenna 1 is bent.

According to antenna theory, the higher a frequency is, the more apparent skin effect is. The thickness of the metal foil 2 affects the characteristics of the slot antenna 1 much more than the area of the metal foil 2. So under high frequency, the metal foil 2 is required to have a. certain degree of thickness to reduce transmission loss of electromagnetic waves generated by the slot antenna 1. In the preferred embodiment, the metal foil 2 is at least 35 um thick for the frequency band of 2400 MHz~2500 MHz.

Figure 2:
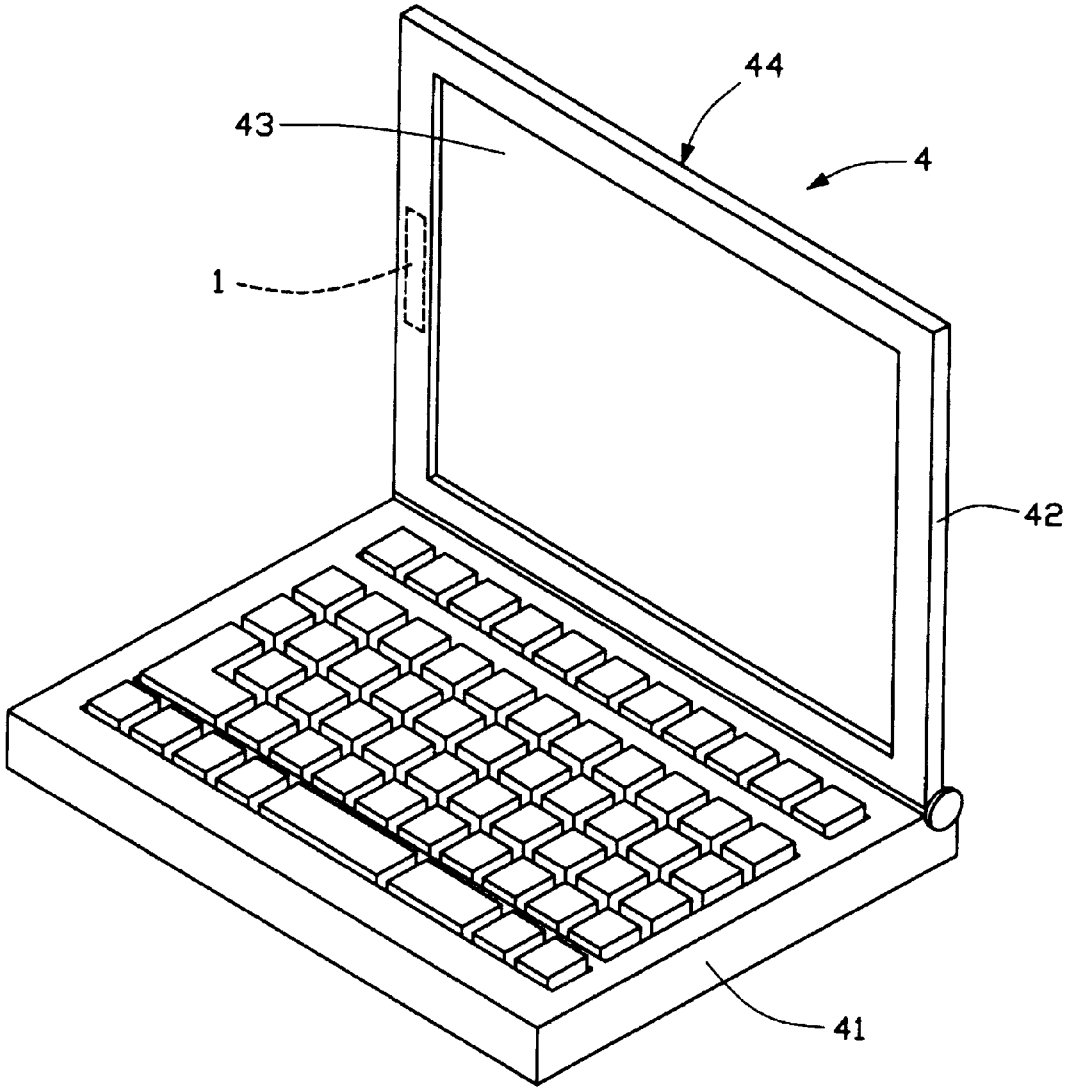
FIG. 2 is a perspective view of a notebook computer incorporating the slot antenna assembly of FIG. 1.
Figure 3:
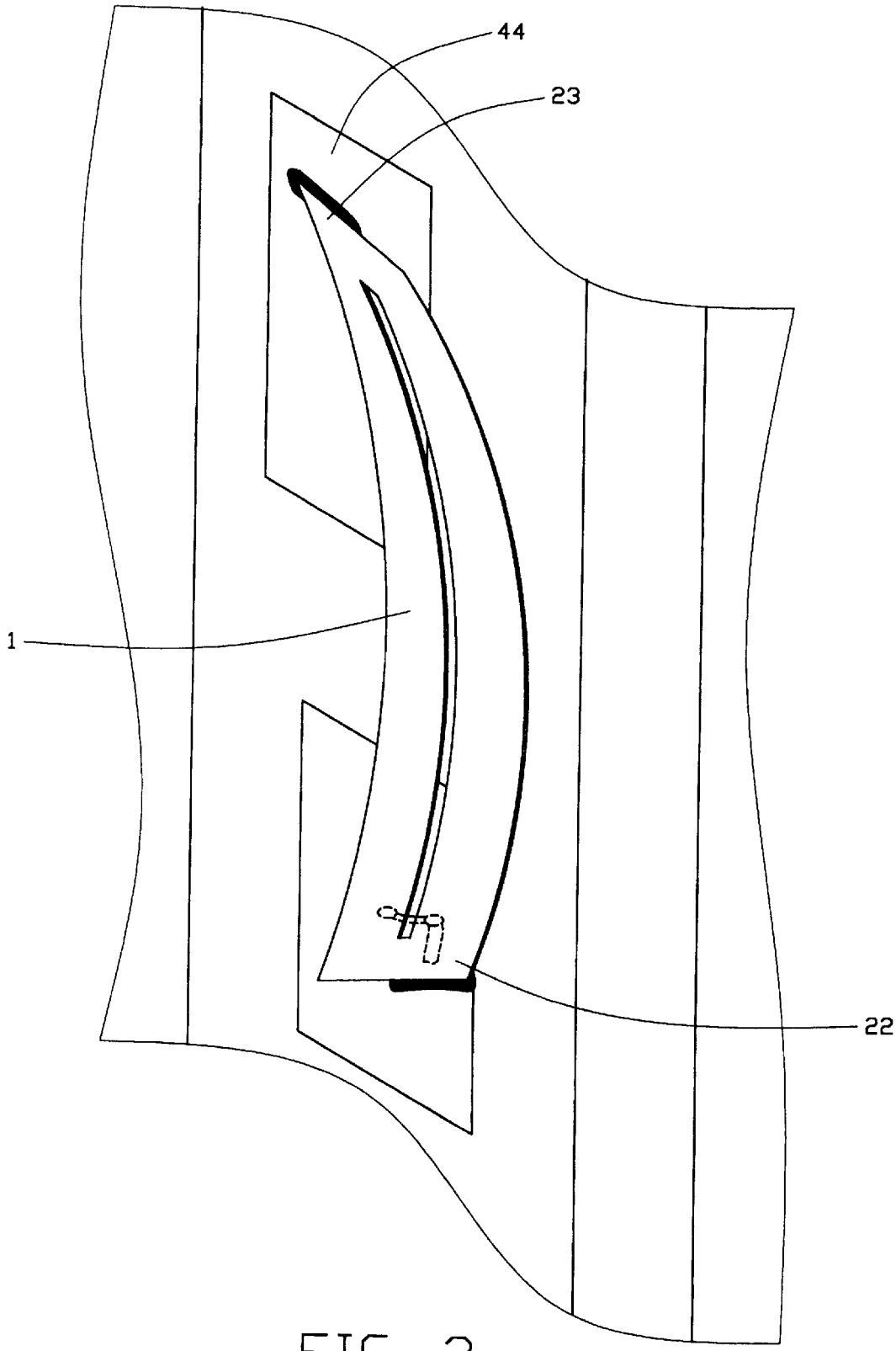
FIG. 3 shows the slot antenna assembly of FIG. 1 being assembled in the notebook computer of FIG. 2.

Referring to FIGS. 2–3, a notebook computer 4 comprises a mainframe 41 and a lid 42 containing a Liquid Crystal Display (LCD) panel 43. The LCD panel 43 is mounted on a back plane of the lid 42, and is spaced apart from a main inner surface 44 of the lid 42. The slot antenna 1 is attached to a side of the inner surface 44, as shown by dotted lines beside the LCD panel 43. The slot antenna 1 is soldered to the inner surface 44 of the notebook 4 at opposite ends of the slot antenna 1. All the following experimental data and radiation patterns were obtained when the LCD panel 43 was open.

Figure 4:
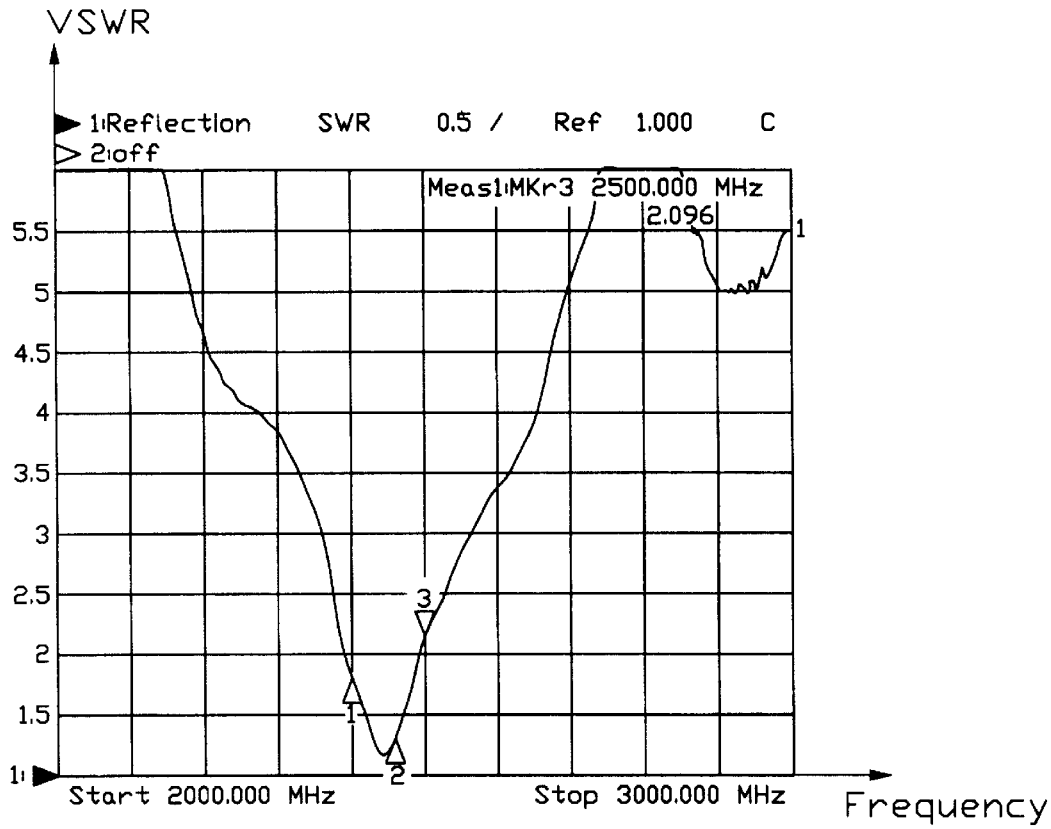
FIG. 4 is a graph of experimental data obtained for the slot antenna assembly of FIG. 1, showing frequency on the horizontal axis varying with Voltage Standing Wave Ratio (VSWR) on the vertical axis.

FIG. 4 is a graph of experimental data, showing frequency on the horizontal axis varying with the VSWR on the vertical axis. The VSWR determines the rate of power feeding into the antenna and the characteristics of the antenna under a certain frequency. Generally, the VSWR is reasonable when it is greater than 1.0. When the VSWR is less than 2.0, up to 10% of energy is reflected back and becomes transmission loss, and remaining energy is radiated out through the antenna. Antenna designers accordingly seek to attain a VSWR greater than 1 and less than 2 under the desired frequency band. According to the experimental data in the table in FIG. 4, if the frequency is 2400 MHz, the VSWR is 1.789 (see triangle 1). If the frequency is 2450 MHz, the VSWR is 1.211 (see triangle 2). If the frequency is 2500 MHz, the VSWR is 2.096 (see triangle 3). These results are reasonable under the desired frequency band 2400 MHz~2500 MHz.

Figure 5:
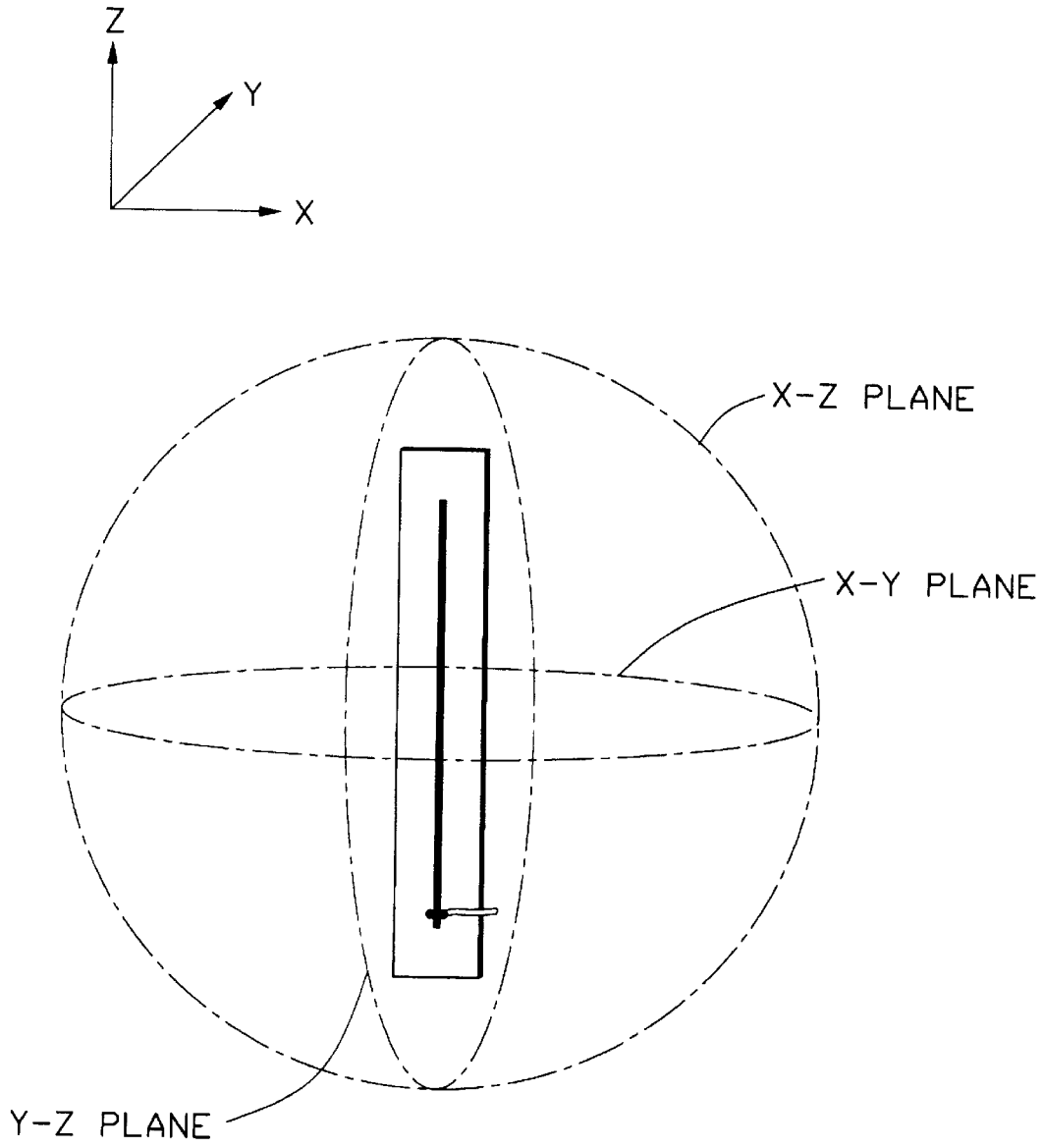
FIG. 5 shows a measurement coordinate system and orientation of axes for the slot antenna assembly of FIG. 1.

FIGS. 1 and 5 show a measurement coordinate system and orientation of axes for the preferred embodiment. Measured radiation patterns in different directions are shown in FIGS. 6–11, and are based on such system and orientation. The measured radiation patterns were all obtained at a frequency of 2450 MHz.

Figure 6:
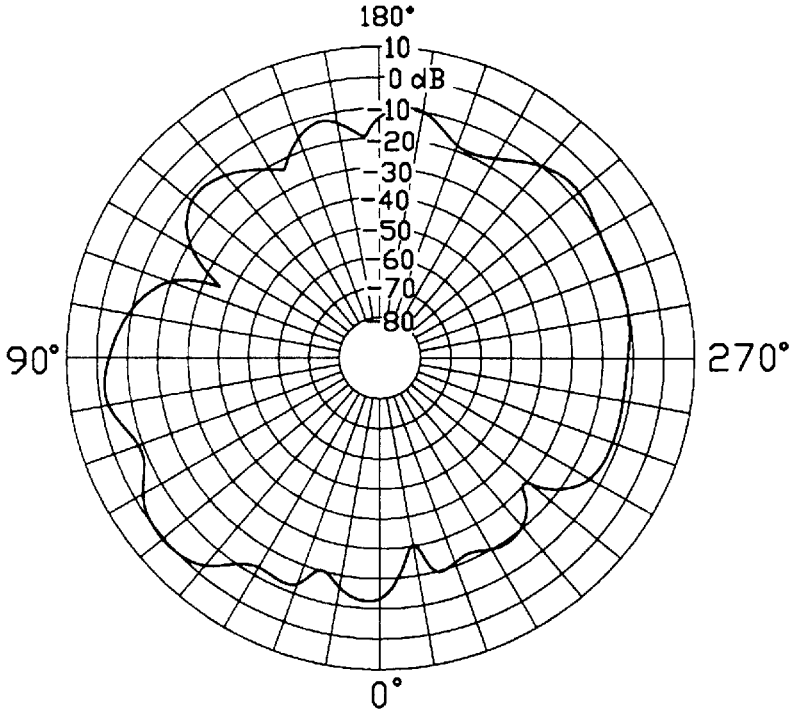
FIG. 6 shows a measured radiation pattern in an X-Z plane in vertical polarization of the slot antenna assembly of FIG. 1.
Figure 7:
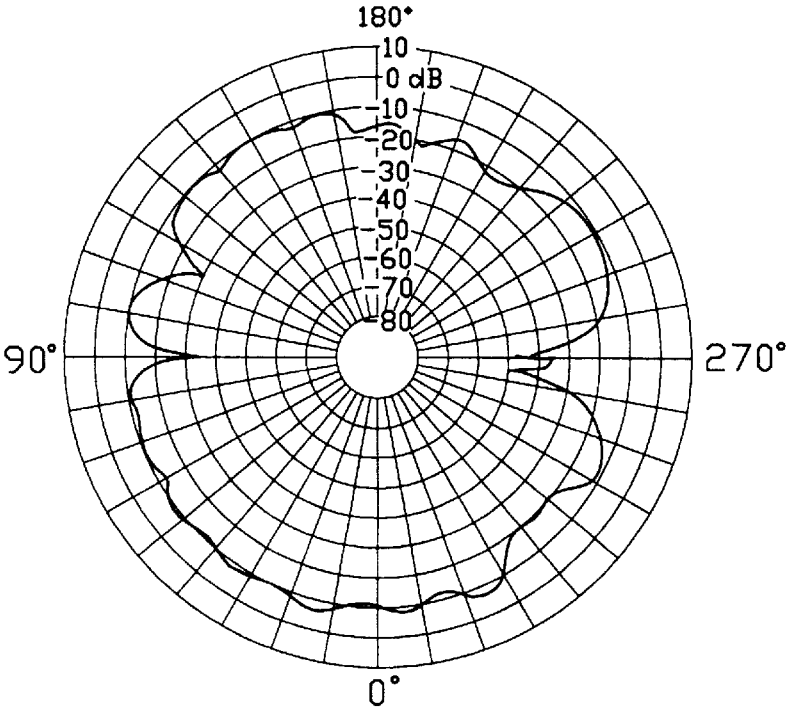
FIG. 7 shows a measured radiation pattern in the X-Z plane in horizontal polarization of the slot antenna assembly of FIG. 1.

FIGS. 6 and 7 show radiation patterns in the X-Z plane. The maximum directive gain of the slot antenna 1 was approximately −6 dB in horizontal polarization, and approximately 0 dB in vertical polarization. At radiation angles 90° and 270°, the directive gain was respectively −34 dB and −48 dB in horizontal polarization, and −4 dB and −11 dB in vertical polarization. As is clearly shown in FIGS. 6 and 7, no significant radiation void existed in the directive gain.

Figure 8:
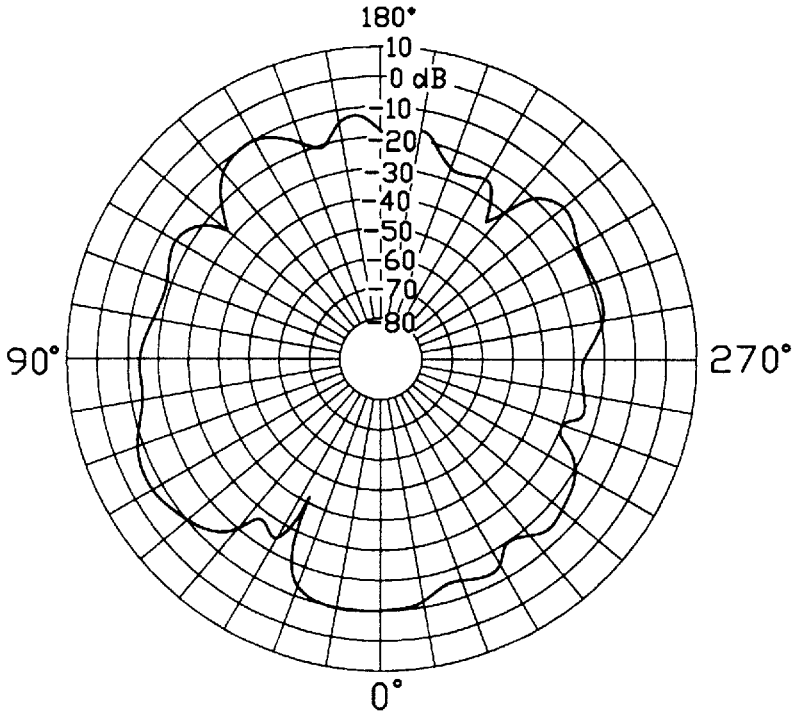
FIG. 8 shows a measured radiation pattern in an X-Y plane in vertical polarization of the slot antenna assembly of FIG. 1.
Figure 9:
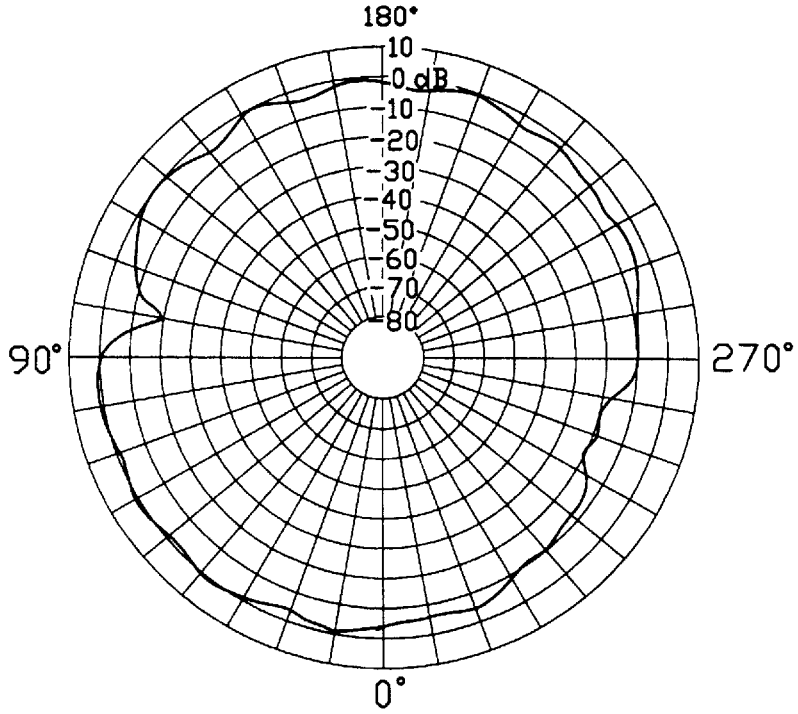
FIG. 9 shows a measured radiation pattern in the X-Y plane in horizontal polarization of the slot antenna assembly of FIG. 1.

FIGS. 8 and 9 show radiation patterns in the X-Y plane. The maximum directive gain of the slot antenna 1 was approximately 0 dB in horizontal polarization, and approximately −6 dB in vertical polarization. When the radiation angle was in the range of 0° to 360°, the directive gain was in the range of 0 dB to −42 dB. As is clearly shown in FIGS. 8 and 9, no significant radiation void existed in the directive gain.

Figure 10:
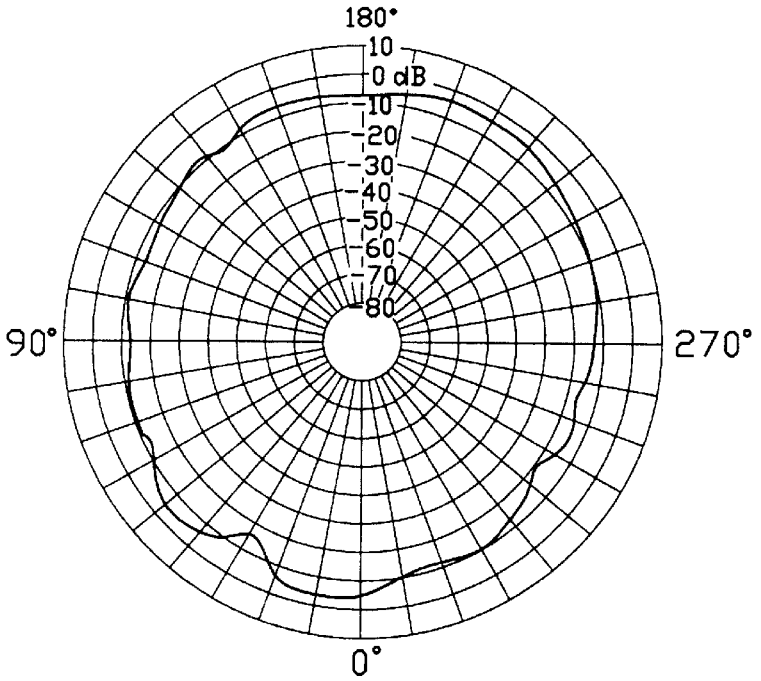
FIG. 10 shows a measured radiation pattern in a Y-Z plane in vertical polarization of the slot antenna assembly of FIG. 1.
Figure 11:
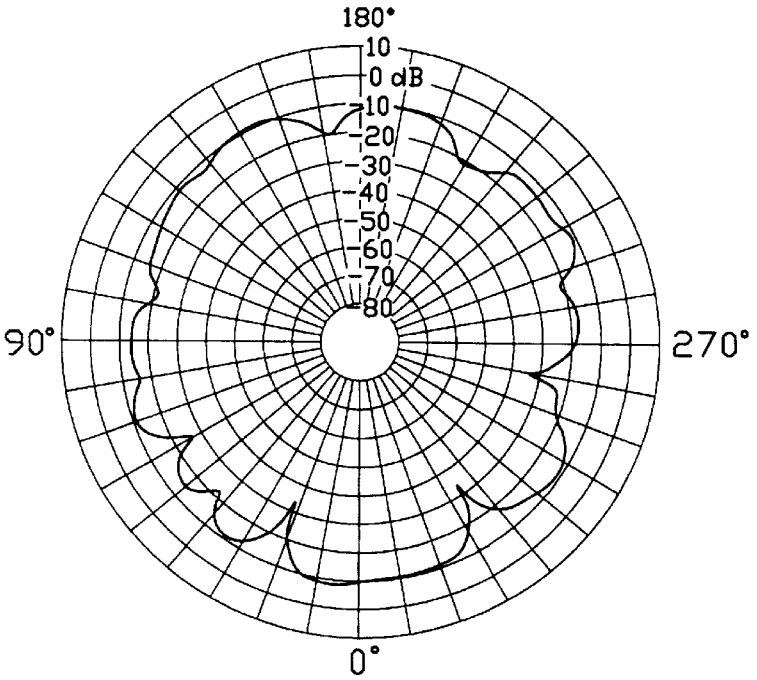
FIG. 11 shows a measured radiation pattern in the Y-Z plane in horizontal polarization of the slot antenna assembly of FIG. 1.

FIGS. 10 and 11 show radiation patterns in the Y-Z plane. The maximum directive gain of the slot antenna 1 was approximately −9 dB in horizontal polarization, and approximately −3 dB in vertical polarization. When the radiation angle was in the range of 0° to 360°, the directive gain was in the range of −9 dB to −35 dB. As is clearly shown in FIGS. 10 and 11, no significant radiation void existed in the directive gain. Thus the radiation patterns in the X-Y plane, Y-Z plane and X-Z plane were all standard at the frequency of 2450 MHz.

The table in FIG. 12 shows total average gains of the slot antenna 1 in he X-Y plane, the Y-Z plane and the X-Z plane at different frequencies when the lid 42 of the notebook computer 4 was open. The table in FIG. 15 shows corresponding data for the conventional flat slot antenna 14 shown in FIG. 13.

Comparing FIG. 12 to FIG. 15, the average gain of the slot antenna 1 in the X-Z plane is 1~3 dB more than the average gain of the conventional flat slot antenna 14 in the X-Z plane. Furthermore, the average gain of the slot antenna 1 in the X-Y plane is approximately 1~3 dB more than the average gain of the conventional flat slot antenna 14 in the X-Y plane. Moreover, the average gain of the slot antenna 1 in the Y-Z plane is approximately 0.11 dB more than the average gain of the conventional flat slot antenna 14 in the Y-Z plane. Thus, the total average gain of the slot antenna 1 is 1~2 dB more than that of the conventional flat slot antenna 14.

In addition, under microscopic view, the slot antenna 1 can be seen to be the equivalent of a synthesis of hundreds of thousands of small flat slot antennas uniformly arranged to face progressively different directions. Moreover, as mentioned before, the foil is diagonally bent in this embodiment. Alternately, a twisted foil may be another performed type used in the invention.

In the summary, the experimental data proves that the slot antenna 1 of the present invention achieves omni-directional radiation and increased radiation electric field intensity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly for an electronic device, comprising:

a slot antenna comprising a metal foil bent diagonally and defining an elongated slot therein; and a coaxial feeder cable, an inner core wire of the cable being soldered to the antenna at a first feed-in point near the slot, and an outer shield of the cable being soldered to the antenna at a second feed-in point near the slot and opposite the first feed-in point.

2. The antenna assembly as claimed in claim 1, wherein the metal foil is bent into an arch with a torsional twist, and wherein diagonally opposite corners of the metal foil are soldered to the electronic device.

3. The antenna assembly as claimed in claim 1, wherein an X-axis defines a lateral central axis of the unbended metal foil and a Z-axis defines a longitudinal central axis of the unbended metal foil, and wherein the metal foil is bent relative to a center of at least one of the X-axis thereof and the Z-axis thereof.

4. The antenna assembly as claimed in claim 1, wherein the first and second feed-in points of the coaxial cable are respectively distanced from the slot, and the positions of the feed-in points are changeable according to degrees which the metal foil is bent.

5. The antenna assembly as claimed in claim 1, wherein the metal foil is bent according to a desired frequency band.

6. The antenna assembly as claimed in claim 1, wherein the slot is dimensioned for operation at a predetermined frequency range.

7. The antenna assembly as claimed in claim 1, wherein the slot antenna operates at a frequency band ranging from 2.4 GHz to 2.5 GHz.

8. An antenna assembly for an electronic device, comprising:

a slot antenna comprising a self-twisted metal foil and defining an elongated slot therein; and a coaxial feeder cable, an inner core wire of the cable being soldered to the antenna at a first feed-in point near the slot, and an outer shield of the cable being soldered to the antenna at a second feed-in point near the slot and opposite the first feed-in point.

9. The antenna assembly as claimed in claim 8, wherein the metal foil is bent into an arch with a torsional twist, and wherein diagonally opposite corners of the metal foil are soldered to the electronic device.

10. The antenna assembly as claimed in claim 8, wherein an X-axis defines a lateral central axis of the unbended metal foil and a Z-axis defines a longitudinal central axis of the unbended metal foil, and wherein the metal foil is bent relative to a center of at least one of the X-axis thereof and the Z-axis thereof.

11. The antenna assembly as claimed in claim 8, wherein the first and second feed-in points of the coaxial cable are respectively distanced from the slot, and the positions of the feed-in points are changeable according to degrees to which the metal foil is bent.

12. The antenna assembly as claimed in claim 8, wherein the metal foil is bent according to a desired frequency band.

13. The antenna assembly as claimed in claim 8, wherein the slot is dimensioned for operation at a predetermined frequency range.

14. The antenna assembly as claimed in claim 8, wherein the slot antenna operates at a frequency band ranging from 2.4 GHz to 2.5 GHz.

15. An antenna assembly for an electronic device, comprising:

a slot antenna comprising a metal foil defining an elongated slot therein, the metal foil being bent into an arch with a torsional twist; and a coaxial feeder cable, an inner core wire of the cable being soldered to the antenna at a first feed-in point near the slot, and an outer shield of the cable being soldered to the antenna at a second feed-in point near the slot and opposite the first feed-in point.

16. The antenna assembly as claimed in claim 15, wherein diagonally opposite corners of the metal foil are soldered to the electronic device.

17. The antenna assembly as claimed in claim 15, wherein an X-axis defines a lateral central axis of the unbended metal foil and a Z-axis defines a longitudinal central axis of the unbended metal foil, and wherein the metal foil is bent relative to a center of at least one of the X-axis thereof and the Z-axis thereof.

18. The antenna assembly as claimed in claim 15, wherein the first and second feed-on point of the coaxial cable are respectively distanced from the slot, and the positions of the feed-in pints are changeable according to degrees to which the metal foil is bent.

* * * * *